US009296251B2

(12) United States Patent
McAllister

(10) Patent No.: US 9,296,251 B2
(45) Date of Patent: Mar. 29, 2016

(54) REMOVABLE PROTECTIVE DOOR COVERING FOR ARTS AND CRAFTS

(71) Applicant: Julia K. McAllister, Oxford, CT (US)

(72) Inventor: Julia K. McAllister, Oxford, CT (US)

( * ) Notice: Subject to any disclaimer, the term of this patent is extended or adjusted under 35 U.S.C. 154(b) by 15 days.

(21) Appl. No.: 14/317,012

(22) Filed: Jun. 27, 2014

(65) Prior Publication Data

US 2015/0375560 A1 Dec. 31, 2015

(51) Int. Cl.
*B44C 1/10* (2006.01)
*B44C 5/04* (2006.01)

(52) U.S. Cl.
CPC ..... *B44C 1/105* (2013.01); *B44C 5/0461* (2013.01); *Y10T 428/14* (2015.01); *Y10T 428/1486* (2015.01); *Y10T 428/28* (2015.01)

(58) Field of Classification Search
CPC . B44C 5/04; Y10T 428/24008; Y10T 428/14; Y10T 428/28; Y10T 428/1486
See application file for complete search history.

(56) References Cited

U.S. PATENT DOCUMENTS 8,367,176 B1 * 2/2013 Biancella ..... B41M 3/18 428/40.1
2001/0024720 A1 * 9/2001 Sweet ..... B41M 5/52 428/343
2002/0066250 A1 * 6/2002 Plager ..... B44C 5/00 52/311.1
2003/0026940 A1 2/2003 Bullock
2007/0065618 A1 * 3/2007 Fischer ..... B44C 1/162 428/40.1
2007/0287143 A1 * 12/2007 Krongard ..... A47B 97/04 434/421
2008/0003392 A1 * 1/2008 Maule ..... G09F 3/02 428/40.1
2015/0118433 A1 * 4/2015 Khorsandi ..... E04F 13/002 428/42.1

OTHER PUBLICATIONS

AR WRAPS web pages, 6 pages, retrieved on May 5, 2014: <URL: http://arwraps.us/whats-new?tag=Door+wrap>.

* cited by examiner

*Primary Examiner* — Patricia L Nordmeyer
(74) *Attorney, Agent, or Firm* — Lipsitz & McAllister, LLC

(57) ABSTRACT

The present invention relates to removable door covering having a back side coated with an adhesive material and a front side adapted for at least one of writing, drawing, coloring, and painting on. The adhesive material may be a self-stick removable adhesive which leaves no residue when the door covering is applied to a door and subsequently removed. A hole or cutout may be provided through the front and back sides of the door covering enabling the door covering to be applied over or around a doorknob when the door covering is placed on the door.

15 Claims, 6 Drawing Sheets

REMOVABLE PROTECTIVE DOOR COVERING FOR ARTS AND CRAFTS

BACKGROUND OF THE INVENTION

The present invention relates to a removable protective door covering which can be drawn or colored on or to which photos, stickers, or other decorative items can be taped or glued to.

It is well-known that children like to decorate the doors to their rooms, by taping pictures or photos to the door, applying stickers to the door, or drawing, coloring, or painting the door. However, such decorations either permanently change the door appearance (in the case of writing, drawing, coloring or painting on the door) or damage the door finish in some way (in the case of taping, gluing, or applying stickers to the door). Parents typically are reluctant to permit children to permanently modify their doors or to damage them in any way.

Accordingly, it would be advantageous to provide a door covering which protects the door and permits children to draw, color, or paint on or to glue, stick, or tape items to, or to otherwise decorate their doors. It would be advantageous if such a door covering was easily removable without leaving any residue on the door finish or damaging the door in any way.

The door covering of the present invention provides the foregoing and other advantages.

SUMMARY OF INVENTION

The present invention relates to a removable protective door covering which can be drawn, colored, or painted on. In addition, photos, stickers, or other decorative items can be taped or glued to the door covering.

In one example embodiment, the removable door covering may comprise a back side coated with an adhesive material, a front side adapted for at least one of writing, drawing, coloring, and painting on, the adhesive material comprising a self-stick removable adhesive which leaves no residue when the door covering is applied to a door and subsequently removed.

In addition, a hole may be provided through the front and back sides which is adapted to enable a doorknob to pass through the door covering when the door covering is placed on the door.

Alternatively, a cutout may be provided on a side of the door covering for a doorknob.

The door covering may be produced in a plurality of standard sizes to fit a corresponding plurality of standard sized doors.

The front side may comprise one of craft paper, art paper, construction paper, a flexible dry-erase material, or a flexible white-board material.

The back side may comprise a peel and stick backing paper with a removable backing sheet covering the adhesive material. The door covering may be packaged in roll form.

The front side may be plain without any pre-printed matter. The front side may be one of white, light colored, pastel colored, or multi-colored using light colors.

In a further example embodiment, a decorative border on a periphery of the front side may be provided. The decorative border may comprise at least one of artwork, flowers, sports images, quotes, colored areas, arbitrary designs, seasonal themes, and the like.

The front side may comprise an area for at least one of preprinted text or graphics and an area for the at least one of writing, drawing, coloring, painting, and the like. The preprinted text or graphics may comprise at least one of text, artwork, photographs, decorations, a quotation, a child's name, a monthly or yearly calendar, paint- or draw-by-number picture outlines, coloring outlines, and the like.

The front side may be further adapted for sticking, taping, gluing, or pasting items onto.

In addition, a filler material may be provided for filling in grooves or gaps in a surface of a door to provide a substantially flat planar surface for the door covering. For example, such filler material may be used to fill in grooves in panelized doors or doors with ornate woodwork to provide a substantially smooth surface for application of the door covering. The filler material may comprise a back side contoured to fit in the grooves or gaps which is coated with the adhesive material and a smooth front side. Alternatively, the filler material may be provided in standard shapes which may then be cut to fit the grooves.

A set of colored pens, pencils, or markers may be sold with the door covering which are specifically adapted for use on the front side of the door covering.

DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

The present invention as shown in FIGS. 1-5 relates to a removable protective door covering 10 for a door 12. The door covering 10 can be drawn, colored, or painted on. In addition, photos, stickers, or other decorative items can be taped or glued to the door covering.

Figure 1:
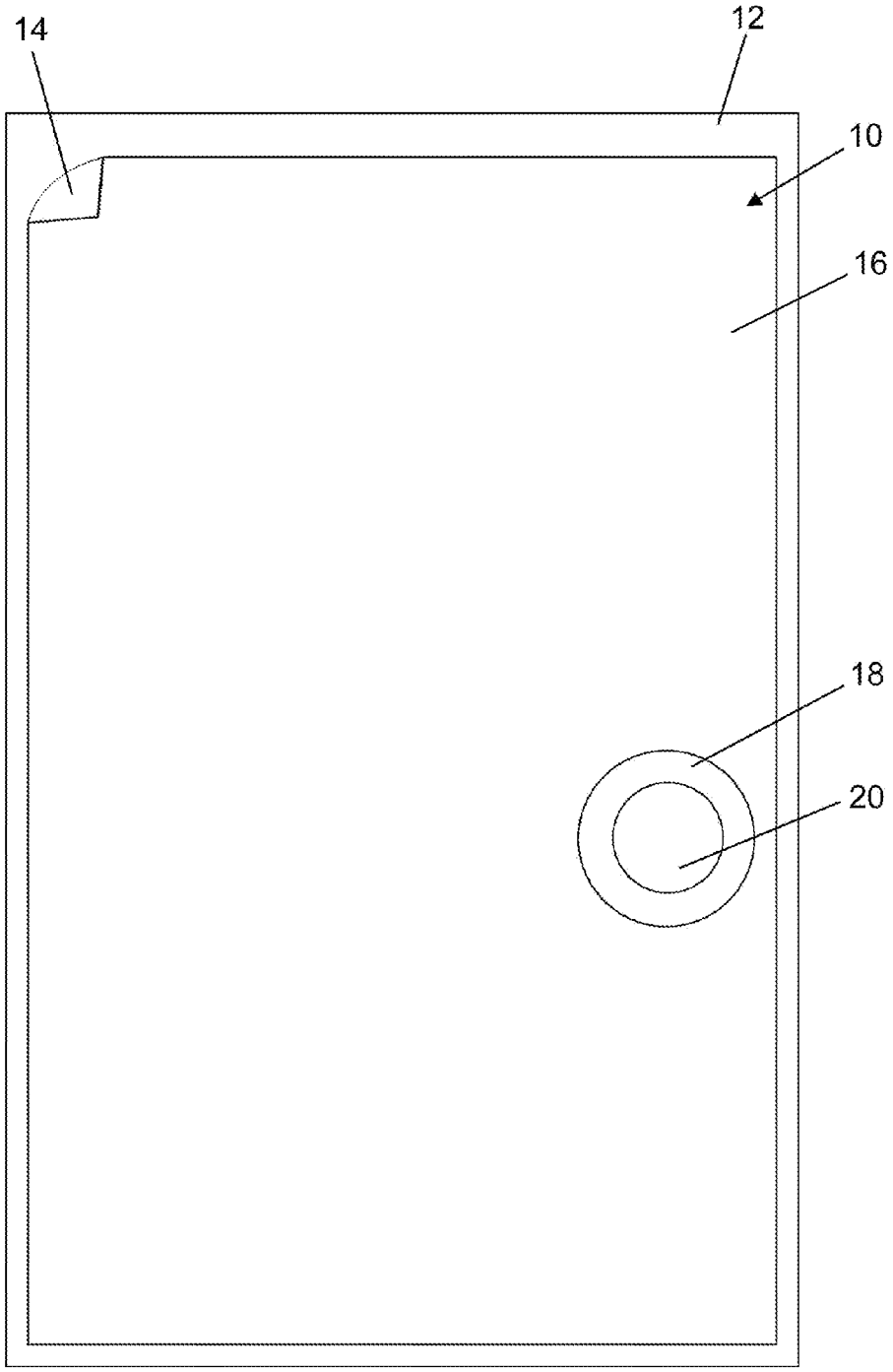
FIG. 1 shows an example embodiment of a removable door covering in accordance with the present invention.

In one example embodiment as shown in FIG. 1, the removable door covering 10 may comprise a back side 14 coated with an adhesive material 15 (see FIG. 2), a front side 16 adapted for at least one of writing, drawing, coloring, and painting on. The adhesive material may comprise a self-stick removable adhesive which leaves no residue when the door covering 10 is applied to a door 12 and subsequently removed. FIG. 1 shows an upper left hand corner of the door covering 10 peeled back from the door 12 to reveal the back side 14.

In addition, a hole 18 may be provided through the front and back sides which is adapted to enable a doorknob 20 to pass through the door covering 10 when the door covering 10 is placed on the door 12. The hole 18 may be sufficiently large enough to accommodate most doorknobs and to make it relatively easy to apply the door covering without contacting the doorknob 20.

The door covering 10 may be produced in a plurality of standard sizes to fit a corresponding plurality of standard sized doors 12.

Figure 2:
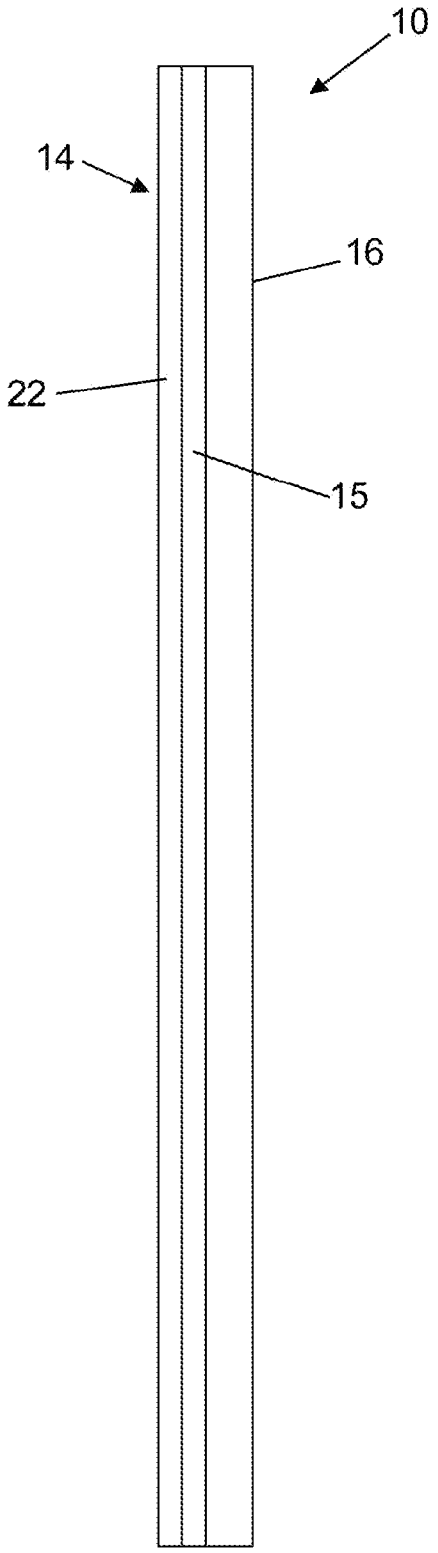
FIG. 2 shows an example embodiment of a side view of the removable door covering of FIG. 1.

FIG. 2 shows an enlarged side view of an example embodiment of the removable door covering 10 of the present invention. The front side 16 may comprise one of craft paper, art paper, construction paper, a flexible dry-erase material, or a flexible white-board material. The back side 14 may comprise a peel and stick backing paper 22 with a removable backing sheet covering the adhesive material 15. The door covering 10 may be packaged in roll form.

The front side 16 may be plain without any pre-printed matter, as shown in FIG. 1. The front side may be one of white, light colored, pastel colored, or multi-colored using light colors.

Figure 3:
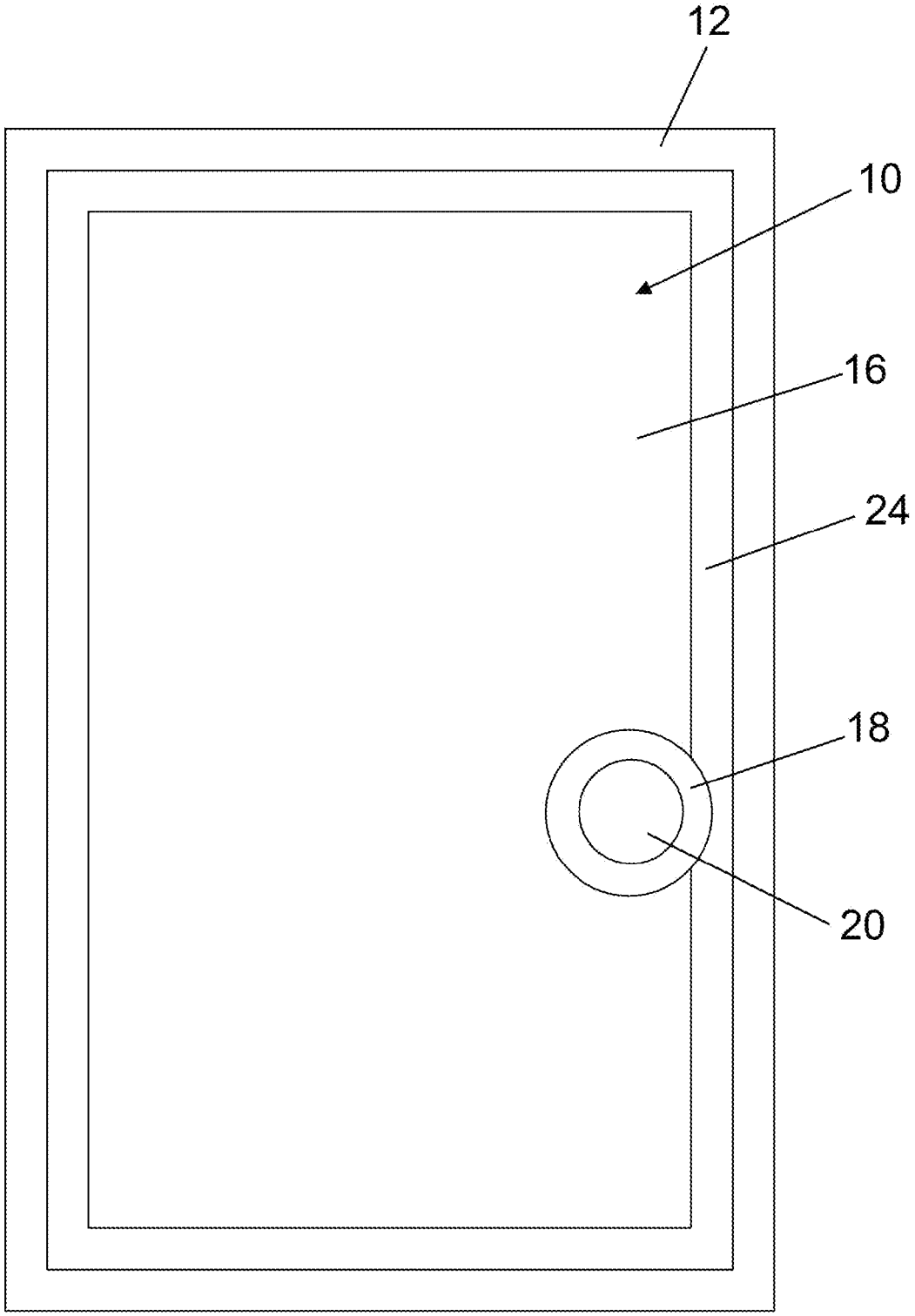
FIG. 3 shows additional features of a removable door covering in accordance with the present invention.

In a further example embodiment as shown in FIG. 3, a decorative border 24 on a periphery of the front side 16 may be provided. The decorative border 24 may comprise at least one of artwork, flowers, sports images, quotes, colored areas, arbitrary designs, seasonal themes, and the like.

Figure 4:
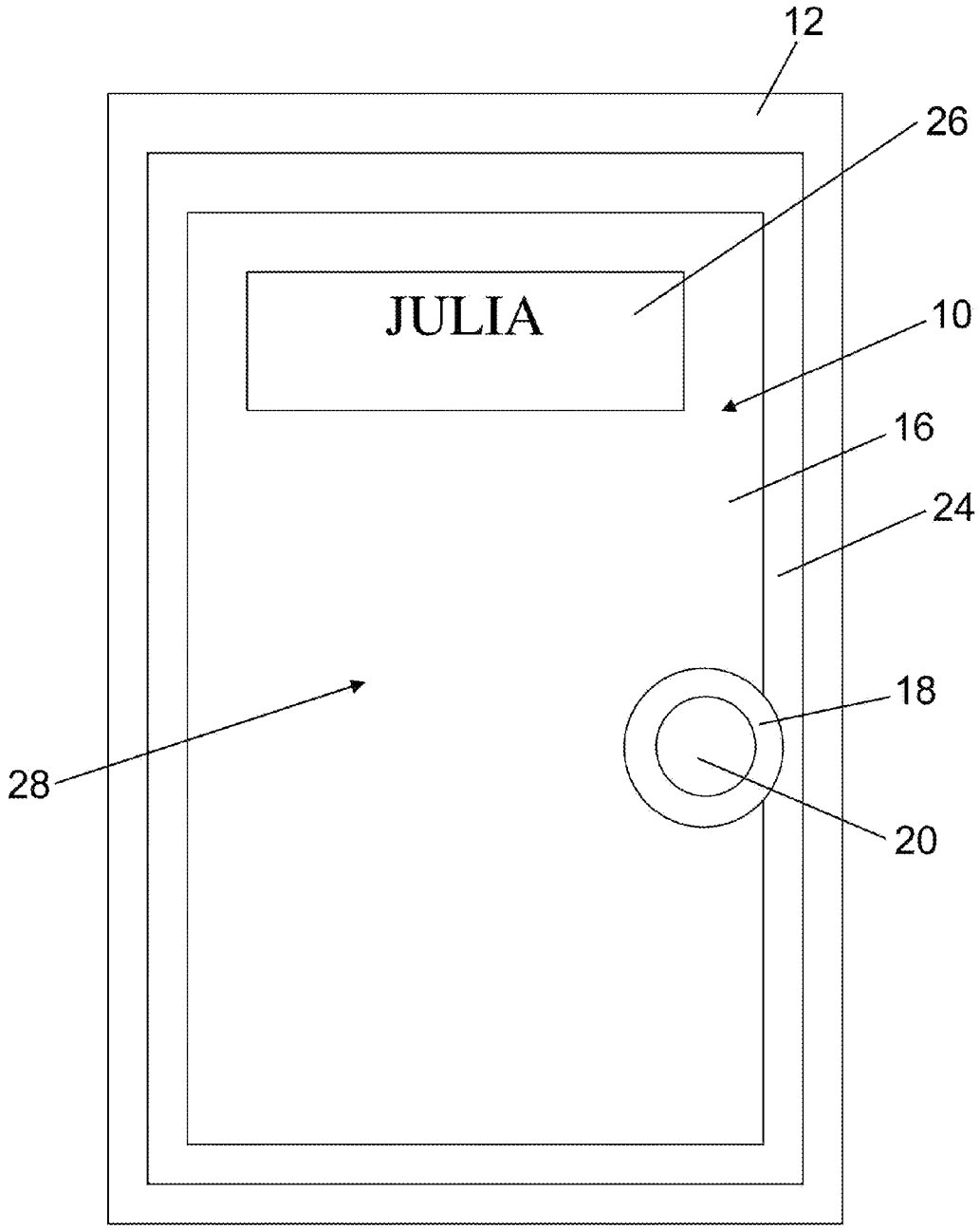
FIG. 4 shows additional features of a removable door covering in accordance with the present invention.

As shown in FIG. 4, the front side 16 may comprise an area 26 for at least one of preprinted text or graphics and an area 28 for the at least one of writing, drawing, coloring, painting, and the like. The preprinted text or graphics in area 26 may comprise at least one of text, artwork, photographs, decorations, a quotation, a child's name, a monthly or yearly calendar, paint- or draw-by-number picture outlines, coloring outlines, and the like. Although FIG. 4 shows the area for preprinted text or graphics in addition to the border 24, those skilled in the art will appreciate that the door covering may comprise the area for preprinted text only, with no decorative border 24.

In addition, the door covering 10 may include more than one area for preprinted matter. For example, the door covering may include an upper area 26 for one form of preprinted matter and additional preprinted matter may be provided in the lower area 28. For example, a child's name, a calendar, or other matter may be provided in area 26 as discussed above. Different preprinted matter may then be provided in lower area 28 (e.g., paint- or draw-by-number picture outlines or coloring outlines). An area may still be provided for writing, drawing, painting, and the like. It should be appreciated that the preprinted matter can be provided on any portion of the door covering 10.

The front side 16 may be further adapted for sticking, taping, gluing, or pasting items onto.

Figure 5:
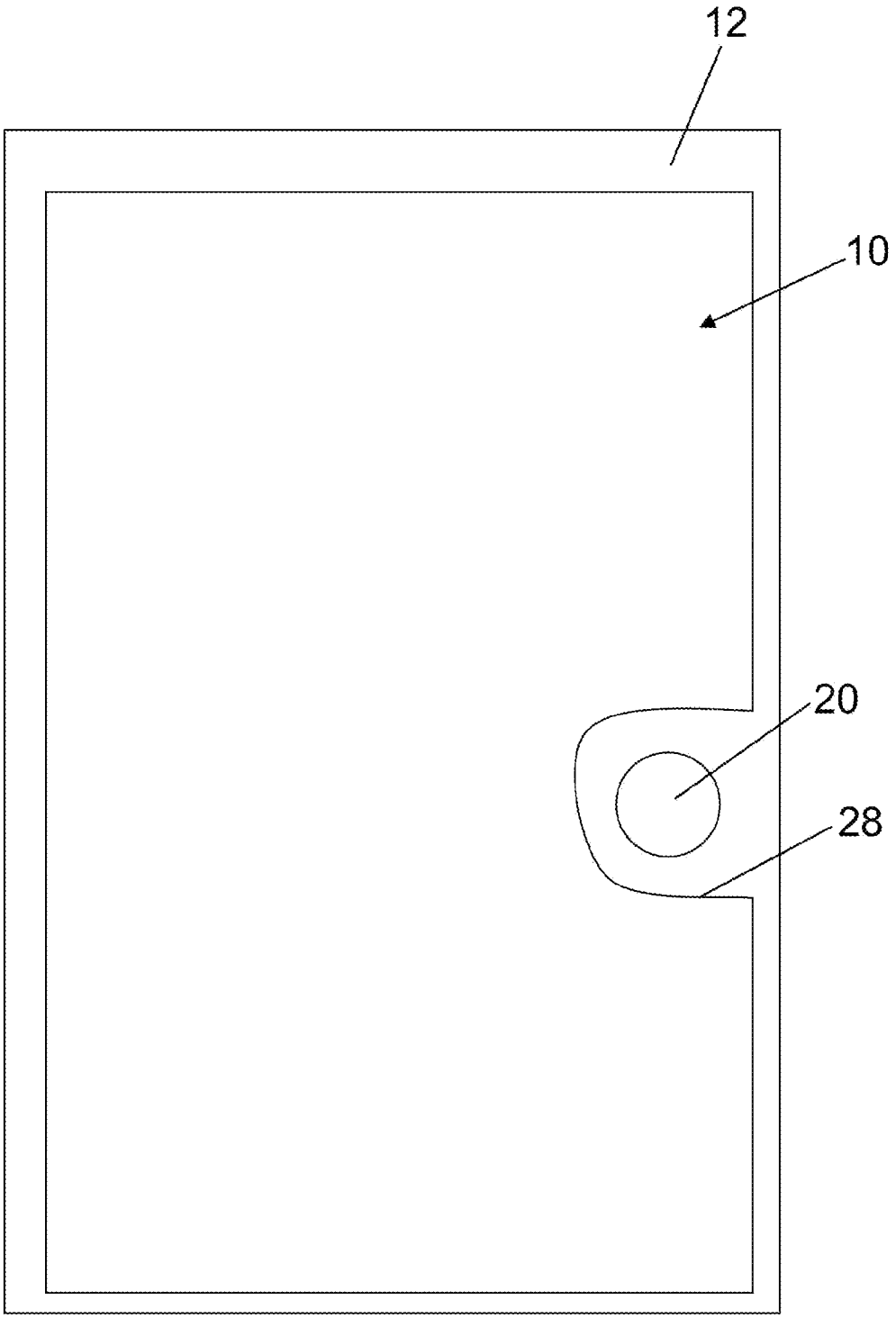
FIG. 5 shows another example embodiment of a removable door covering in accordance with the present invention.

In an alternate embodiment shown in FIG. 5, instead of a hole 18 as shown in FIGS. 1-3, a cutout 28 may be provided on a side of the door covering 10 for a doorknob 20. Such a cutout 28 may make it easier to apply the door covering 10 when the door covering 10 is applied by adhering the top or bottom of the door covering 10 to a corresponding location on the door 12 and then unrolling the door covering 10 onto the door surface. The remaining features mentioned above in connection with FIGS. 1-4 may also be employed on a door covering 10 with a cutout 28 rather than a hole 18.

As the door covering is made from a material that can be easily cut with standard scissors, the door covering may also be manufactured without a hole or cutout. The end user can then create a hole or cutout using scissors at the time of installation on the door, which may be advantageous for non-standard sized doors or doors with unique doorknobs. In addition, the door covering may be cut down to fit any size door (e.g., the door covering may be made in a 36×80 inch size and cut down to fit 32×80 inch doors, or other smaller or non-standard sized doors).

Figure 6:
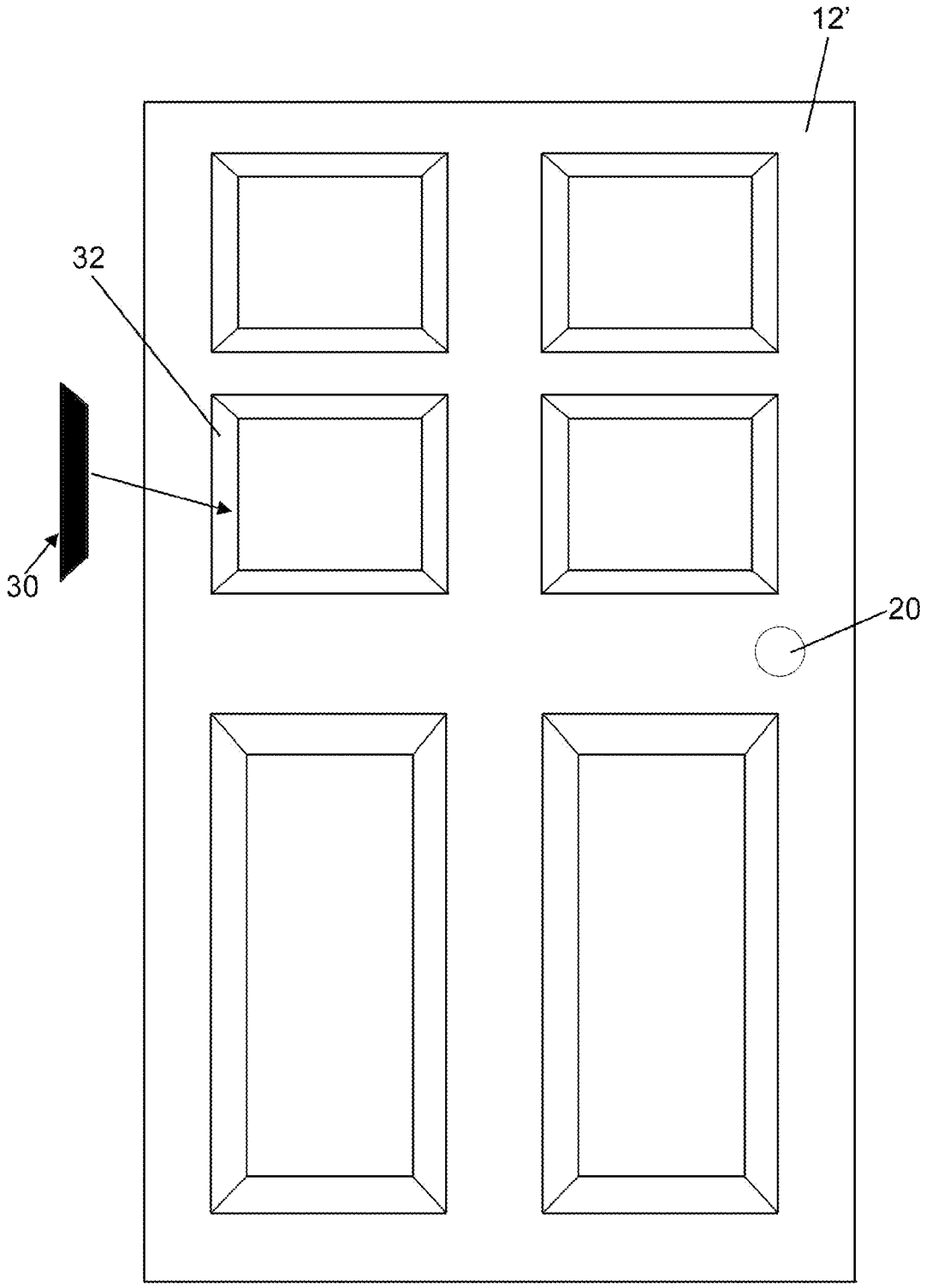
FIG. 6 shows a panelized door with filler material in accordance with an example embodiment of the present invention.

In addition, as shown in FIG. 6, a filler material 30 may be provided for filling in grooves or gaps in a surface of a panelized door 12' to provide a substantially flat planar surface for the door covering 10 (not shown in FIG. 6). For example, such filler material 30 may be used to fill in grooves 32 in a panelized door 12' or doors with ornate woodwork to provide a substantially smooth surface for application of the door covering 10. The filler material 30 may comprise a back side contoured to fit in the grooves 32 or gaps which is coated with the adhesive material and a smooth front side. A removable backing sheet similar to that discussed above with the door covering 10 and FIG. 2 may be provided on the back side of the filler material 30. Alternatively, the filler material 30 may be provided in standard shapes which may then be cut to fit the grooves 32.

Optionally the door covering can be decorated prior to sticking it onto a door, which is advantageous where the door is not flat, for example doors with raised panels or grooves, etc. where no filler material is to be used.

A set of colored pens, pencils, or markers may be sold with the door covering 10 which are specifically adapted for use on the front side 16 of the door covering 10.

The present invention may also be extended to protective wall coverings in addition to door coverings. The wall coverings may be made in various shapes and sizes and include all the features mentioned above (without the need for a hole or cutout for a doorknob). For example, the wall covering may be provided in various standard shapes (square, rectangle, triangle, circle, oval, etc.) or be provided in the form of various designs, including but not limited to a flower, a person, an animal, a piece of sports equipment (a football, football helmet, basketball, baseball, soccer ball, and the like), a cartoon, toy, or movie figure or related item, a house, a car, a truck, a boat, construction equipment, a holiday themed design (Santa, Christmas tree, Easter bunny, etc.), or any other conceivable pattern or design. The wall covering may be provided in white or light colors for decoration as discussed above with the door covering 10, and/or be provided with borders or other preprinted matter (in whole or in part) as discussed above. When provided in the form of a specific design, colors or graphics may be used corresponding to the particular design (e.g., a flower shaped wall covering may be colored like a particular flower, etc.).

It should now be appreciated that the present invention provides an advantageous removable door covering for protecting and decorating a door.

Although the invention has been described in connection with various illustrated embodiments, numerous modifications and adaptations may be made thereto without departing from the spirit and scope of the invention as set forth in the claims.

What is claimed is:

1. A removable door covering kit, comprising:

a removable door covering, comprising:

a back side coated with an adhesive material; and a front side adapted for at least one of writing, drawing, coloring, and painting on;

the adhesive material comprising a self-stick removable adhesive which leaves no residue when the door covering is applied to a door and subsequently removed; and one or more separate pieces of filler material for filling in grooves or gaps in a surface of a door to provide a substantially flat planar surface for subsequent application of the door covering.

2. The removable door covering kit of claim 1, wherein the filler material comprises:

a back side contoured to fit in the grooves or gaps which is coated with the adhesive material, and a smooth front side.

3. The removable door covering kit of claim 1, wherein the door covering further comprises:

a hole through the front and back sides adapted to enable a doorknob to pass through the door covering when the door covering is placed on the door.

4. The removable door covering kit of claim 1, wherein the door covering further comprises:

a cutout forming an indent in a side edge of the door covering adapted to fit around and only partially encompass a doorknob when the door covering is applied to the door.

5. The removable door covering kit of claim 1, wherein the door covering is produced in a plurality of standard sizes to fit a corresponding plurality of standard sized doors.

6. The removable door covering kit of claim 1, wherein the front side comprises one of craft paper, art paper, construction paper, a flexible dry-erase material, or a flexible white-board material.

7. The removable door covering kit of claim 1, wherein the back side comprises a peel and stick backing paper with a removable backing sheet covering the adhesive material.

8. The removable door covering kit of claim 7, wherein the door covering is packaged in roll form.

9. The removable door covering kit of claim 1, wherein a decorative border is on a periphery of the front side.

10. The removable door covering kit of claim 9, wherein the decorative border comprises at least one of artwork, flowers, sports images, quotes, colored areas, arbitrary designs, and seasonal themes.

11. The removable door covering kit of claim 1, wherein the front side comprises an area for at least one of preprinted text or graphics and an area for the at least one of writing, drawing, coloring, and painting.

12. The removable door covering kit of claim 11, wherein the preprinted text or graphics comprises at least one of text, artwork, a photograph, decorations, a quotation, a child's name, a monthly or yearly calendar, paint- or draw-by-number picture outlines, coloring outlines.

13. The removable door covering kit of claim 1, wherein the front side is one of white, light colored, pastel colored, or multi-colored using light colors.

14. The removable door covering kit of claim 1, wherein the front side is further adapted for sticking, taping, gluing, or pasting items onto.

15. The removable door covering kit of claim 1, wherein a set of colored pens, pencils, or markers are sold with the door covering which are specifically adapted for use on the front side of the door covering.

* * * * *